US005141423A

United States Patent [19]

Aikawa et al.

[11] Patent Number: 5,141,423

[45] Date of Patent: Aug. 25, 1992

[54] AXIAL FLOW FLUID COMPRESSOR WITH OIL SUPPLY PASSAGE THROUGH ROTOR

[75] Inventors: Eiichi Aikawa, Yokohama; Takayoshi Fujiwara, Kawasaki; Hisanori Honma; Yoshinori Sone, both of Yokohama; Takuya Hirayama, Fujisawa, all of Japan

[73] Assignee: Kabushiki Kaisha Toshiba, Kawasaki, Japan

[21] Appl. No.: 673,395

[22] Filed: Mar. 22, 1991

[30] Foreign Application Priority Data

Apr. 13, 1990 [JP] Japan ..... 2-98434

[51] Int. Cl.[5] ..... F04B 39/00; F04C 18/344

[52] U.S. Cl. ..... 418/91; 418/93; 418/136; 418/137; 418/220; 417/356

[58] Field of Search ..... 418/91, 93, 98, 83, 418/104, 220, 136, 137; 417/356

[56] References Cited

U.S. PATENT DOCUMENTS

| | | | |
|---|---|---|---|
| 4,871,304 | 10/1989 | Iida et al. | 418/220 |
| 4,872,820 | 10/1989 | Iida et al. | 418/220 |
| 4,875,842 | 10/1989 | Iida et al. | 418/220 |
| 5,026,264 | 6/1991 | Morozumi et al. | 417/356 |

FOREIGN PATENT DOCUMENTS

| | | | |
|---|---|---|---|
| 1-301974 | 12/1989 | Japan | 418/220 |
| 2-19683 | 1/1990 | Japan | 418/220 |
| 2-67490 | 3/1990 | Japan | 418/220 |
| 2-199289 | 9/1990 | Japan | 418/220 |

*Primary Examiner*—Richard A. Bertsch
*Assistant Examiner*—David L. Cavanaugh
*Attorney, Agent, or Firm*—Cushman, Darby & Cushman

[57] ABSTRACT

A compressor having a cylinder and a cylindrical rotational body housed within the cylinder. A spiral groove is formed in the outer peripheral surface of the rotational body, and a spiral blade is fitted in the groove so as to be freely retreated in and projected from the groove in the radial direction of the rotational body. The cylinder and the rotational body are rotated relative to each other by a drive mechanism. A fluid to be compressed is introduced into working chambers defined by the blade, the inner peripheral surface of the cylinder and the outer peripheral surface of the rotational body. The fluid is first guided into the first working chamber from a gas suction port, and then into the second and subsequent working chambers successively, whereby the fluid is compressed. An oil supply mechanism supplies pressurized oil to an oil supply hole formed in the rotational body. The oil supply hole communicates with that area of the bottom of the spiral groove, which corresponds to the position where the second and subsequent working chambers begin when the suction stroke of the first working chamber ends. The pressurized oil urges the outer peripheral surface of the blade onto the inner peripheral surface of the cylinder.

7 Claims, 5 Drawing Sheets

AXIAL FLOW FLUID COMPRESSOR WITH OIL SUPPLY PASSAGE THROUGH ROTOR

BACKGROUND OF THE INVENTION

1. Field of the Invention

The present invention relates to a fluid compressor for compressing a refrigerant gas, for example, in a refrigerating cycle.

2. Description of the Related Art

There are known various types of compressors, for example, reciprocation type, rotary type, etc. In these compressors, however, the structure of a driving unit, such as a crank shaft for transmitting torque to a compressor unit, and the structure of the compressor unit are complex, and the number of parts is large.

In order to increase the compression efficiency of the compressor, a check valve must be provided on the discharge side. In this case, since a pressure difference between both sides of the check valve is very large, the possibility of gas leakage from the check valve is high. As a result, the compression efficiency is decreased.

In order to solve this problem, high precision is required for the respective parts of the compressor and for the assembly thereof, resulting in an increase in manufacturing cost.

U.S. Pat. No. 4,872,820 discloses a fluid compressor wherein a rod is eccentrically disposed within a cylinder, a spiral groove is formed in the outer peripheral surface of the rod, and a spiral blade is slidably fitted in the spiral groove.

The cylinder and the rod move relative to each other, and a fluid is compressed in the axial direction of the cylinder while being transferred from the suction side to the discharge side of the cylinder. The blade is inclined such that an outer peripheral end portion thereof is directed towards the discharge side.

U.S. Pat. No. 4,871,304 discloses a fluid compressor having substantially the same structure as the compressor of U.S. Pat. No. 4,872,820, wherein the pitch of the blade decreases towards the discharge side and a high pressure is created in a bottom space of a spiral groove, in which the blade is fitted, through a pressure introducing path.

U.S. Pat. No. 4,875,842 discloses a fluid compressor having substantially the same structure as the compressor of U.S. Pat. No. 4,872,820, wherein one of bearings for supporting both ends of a cylinder is supported unrotatably but movable in the axial and radial directions of the cylinder, and that the angle of the spiral groove is specified.

In each of the above conventional compressors, the sealing of the blade in the spiral groove is not perfectly maintained, and it is possible that the compressed fluid may leak between working chambers which are adjacent to each other via the blade, resulting in a decrease in compression efficiency.

SUMMARY OF THE INVENTION

In consideration of the above circumstances, the present invention has been made and its object is to provide a fluid compressor capable of improving a sealing property with a relatively simple structure, enhancing lubrication of slidable parts, and increasing a compression efficiency.

In order to achieve the above object, there is provided a fluid compressor comprising: a cylinder; a cylindrical rotational body disposed within the cylinder along the axis of the cylinder and eccentrically to the axis of the cylinder, said rotational body and the cylinder being rotatable relative to each other such that part of the rotational body is put in contact with the inner peripheral surface of the cylinder, and said rotational body having at least one spiral groove formed in the outer peripheral surface of the rotational body; a spiral blade fitted in the spiral groove so as to be freely retreated in and projected from the spiral groove in the radial direction of the rotational body, said spiral blade having an outer peripheral surface put in close contact with the inner peripheral surface of the cylinder, and said spiral blade dividing the space defined between the inner peripheral surface of the cylinder and the outer peripheral surface of the rotational body into a plurality of working chambers; a first working chamber which is one of said plurality of working chambers and is provided with a gas suction port, second and subsequent working chambers being successively formed by every 360° rotation from the first working chamber; drive means for rotating the cylinder and the rotational body relative to each other, guiding a fluid to be compressed from the gas suction port to the first working chamber, and compressing the fluid while transferring the fluid to the second and subsequent working chambers successively; and oil supply means for supplying a pressurized oil into the space between the bottom of the spiral groove and the blade, in accordance with the rotation of the rotational body, thereby urging the outer peripheral surface of the blade onto the inner peripheral surface of the cylinder, said oil supply means including an oil supply path extending along the axis of the rotational body, an oil supply hole communicating with the oil supply path and the bottom of the spiral groove, and guide means for guiding the pressurized oil to the opening of the oil supply path formed at one end of the oil supply path, said oil supply hole of the oil supply means communicating that area of the bottom of the spiral groove, which corresponds to the position where the second and subsequent working chambers begin when the suction stroke of the first working chamber ends.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 5D show a fluid compressor according to an embodiment of the present invention, in which:

FIG. 1 is a cross-sectional view of the entire fluid compressor;

FIG. 2 is a side view of a rotational body;

FIG. 3 is a side view of a blade;

FIG. 4 is a perspective view of disassembled parts of a torque transmission mechanism; and FIGS. 5A to 5D illustrate a compression process of compressing a refrigerant gas.

DETAILED DESCRIPTION OF THE PREFERRED EMBODIMENTS

Embodiments of the present invention will now be described with reference to the accompanying drawings.

Figure 1:
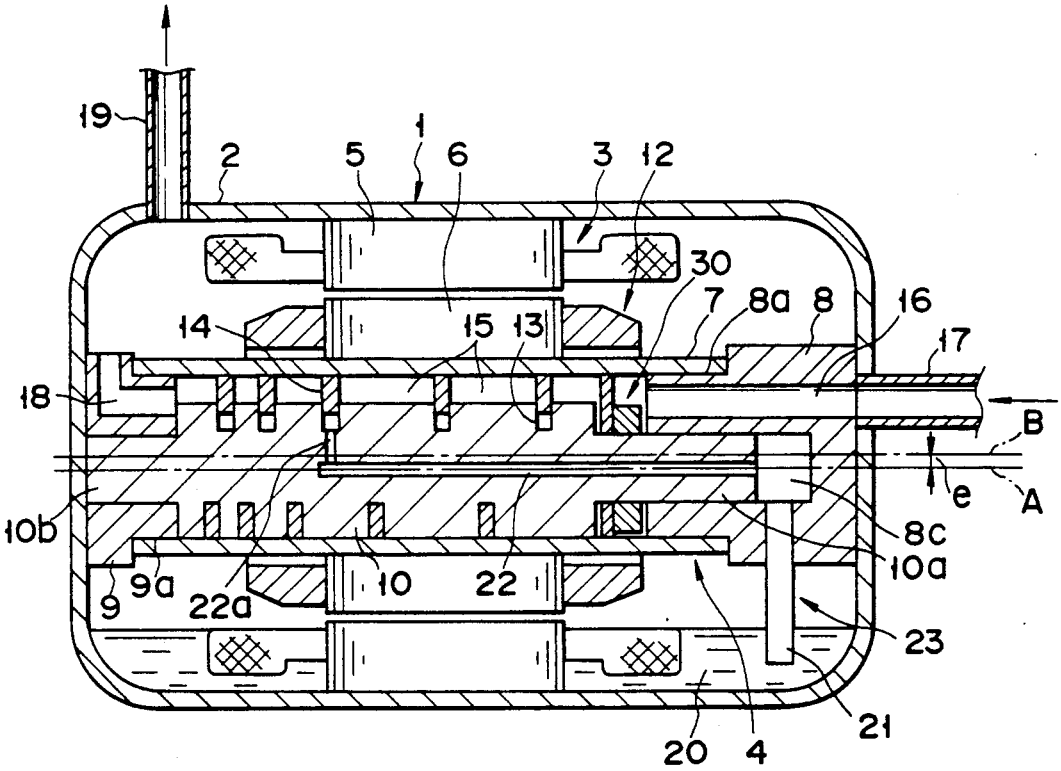

FIG. 1 shows an embodiment of the invention, in which the invention is applied to a compressor for compressing a refrigerant gas in a refrigerating system.

A compressor body 1 comprises a motor unit 3 and a compressor unit 4.

The motor unit 3 comprises an annular stator 5 fixed on the inner surface of a sealed casing 2, and an annular rotor 6 provided inside the stator 5.

The compressor unit 4 has a cylinder 7. The rotor 6 is coaxially fixed on the outer periphery of the cylinder 7.

Both end portions of the cylinder 7 are rotatably supported by a first bearing 8 and a second bearing 9 both fixed on the inner surface of the sealed casing 2. Both ends of the cylinder 7 are air-tightly closed by the first and second bearings 8 and 9.

Specifically, the right-end portion (in FIG. 1), i.e. the suction-side end portion, of the cylinder 7 is rotatably fitted on a peripheral surface portion 8*a* of the first bearing 8. The left-end portion, i.e. the discharge-side end portion, of the cylinder 7 is rotatably fitted on a peripheral surface portion 9*a* of the second bearing 9.

Accordingly, the cylinder 7 and rotor 6 fixed on the cylinder 7 are supported by the first and second bearings 8 and 9 so as to be coaxial with the stator 5.

A rod 10, serving as a cylindrical rotational body, is contained within the cylinder 7 along the axis of the cylinder 7.

The center axis A of the rod 10 is eccentric to the center axis B of the cylinder 7 by a distance e , and part of the outer peripheral surface of the rod 10 is put in contact with the inner peripheral surface of the cylinder 7.

Shaft portions 10*a* and 10*b* are integrally projected from both end portions of the rod 10, and the shaft portions 10*a* and 10*b* are rotatably supported in the first and second bearings 8 and 9.

A gap is provided between an end face of the right shaft portion 10*a* of rod 10 and an end face defining a support hole 8*c* in the first bearing 8, thus forming a space in the first bearing 8.

The right-end portion of the cylinder 7 and the right-side shaft portion 10*a* of the rod 10 are coupled by a torque transmission mechanism 30. When power is supplied to the motor unit 3 to rotate the cylinder 7 and rotor 6 as one body, the toque of the cylinder 7 is transmitted to the rod 10 via the torque transmission mechanism 30.

The motor unit 3 and torque transmission mechanism 30 constitute a drive mechanism 12.

Figure 4:
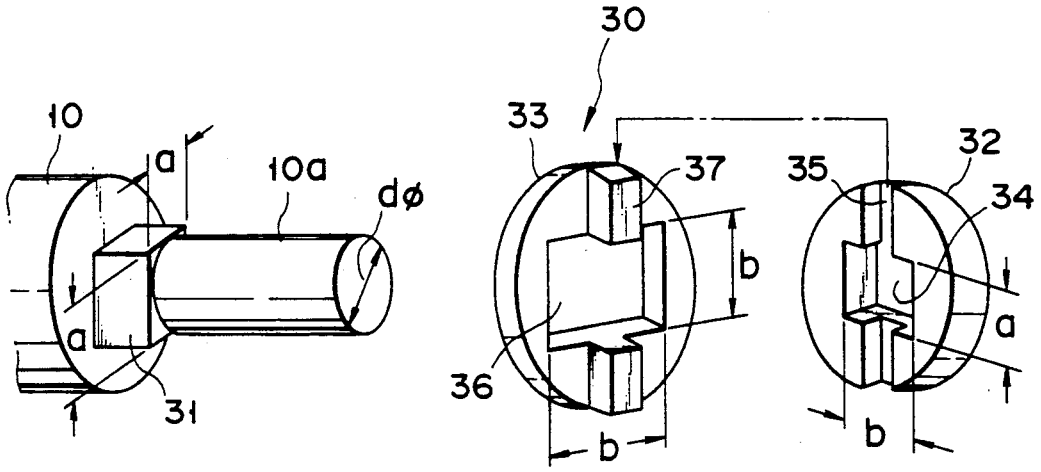
Figure 5A:
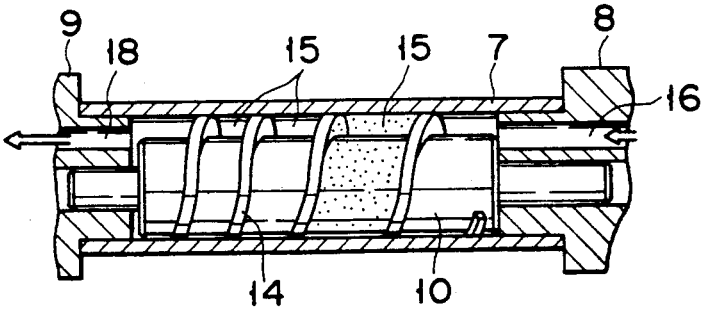
Figure 5B:
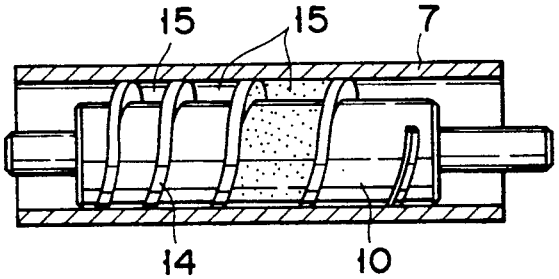
Figure 5C:
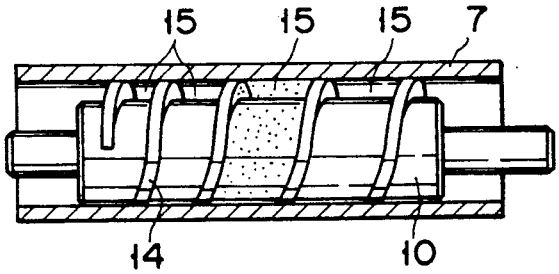
Figure 5D:
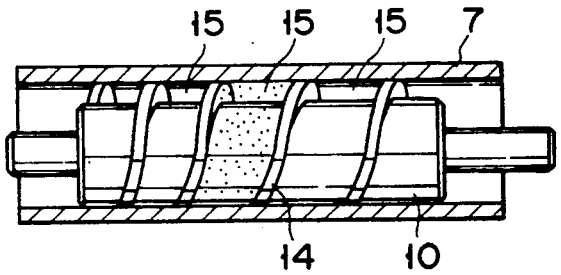

As is shown in FIG. 4, the torque transmission mechanism 30 comprises a rectangular portion 31 continuous with the shaft portion 10*a* of the rod 10, an Oldham ring 32, and an Oldham ring receiver 33.

The rectangular portion 31 has a rectangular cross section, with the dimension of each side being a which is substantially equal or greater than the diameter $\phi$ of the shaft portion 10*a*.

The Oldham ring 32 is a thick disc having a diameter substantially equal to that of the rod 10. A rectangular hook hole 34 is formed in the center part of the ring 32.

The hook hole 34 has a vertical dimension of a so as to be slidable over the rectangular portion 31, and has a horizontal dimension of b which is greater than a.

A vertical Oldham ring groove 35 is formed in one side surface of the Oldham ring 32.

The Oldham ring receiver 33 is a disc having such a diameter as to enable the receiver 33 to be fitted on the inner peripheral surface of the cylinder 7. A guide hole 36 having the dimension of each side of b is formed in the center part of the receiver 33.

A projection 37 slidably engageable with the Oldham ring groove 35 of the ring 32 is formed on one side surface of the Oldham ring receiver 33.

When the cylinder 7 rotates, the Oldham ring receiver 33 also rotates as one body with the cylinder 7. The torque of the cylinder 7 and receiver 33 is transmitted to the rectangular portion 31 and rod 10 through the Oldham ring 32.

The rotational angle speed of the cylinder 7 and rod 10 is kept constant by setting the dimensions of the hook hole 34 and guide hole 36 to be engaged with the rectangular portion 31 and by setting the direction of sliding movement of the guide groove 35 and projection 37.

The rod 10 is rotated within the cylinder 7 with part of the rod 10 kept in contact with the inner surface of cylinder 7. That is, the cylinder 7 and rod 10 are rotated relative to each other.

Figure 2:
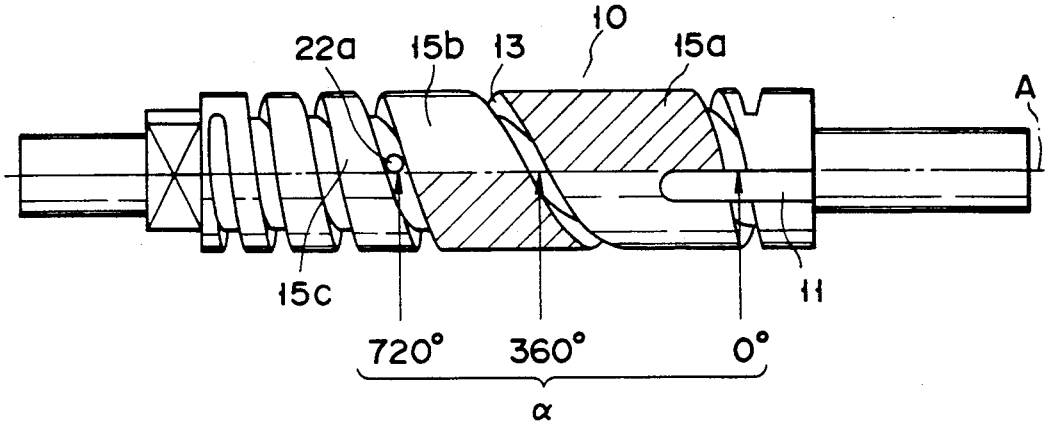

As is shown in FIGS. 1 and 2, the outer peripheral surface of the rod 10 is provided with a spiral groove 13 having a pitch decreasing from the right side to the left side of rod 10, that is, from the suction side to the discharge side of the cylinder 7.

Figure 3:
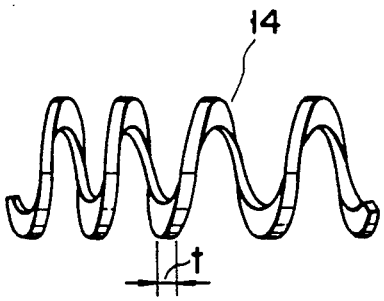

A spiral blade 14, as shown in FIGS. 1 and 3, is fitted in the groove 13. The blade 14 is made of, for example, fluoroplastic material, and has an appropriate elasticity. The thickness of the blade 14 is substantially equal to the width of the groove 13.

The parts of the blade 14 can freely project from and retreat in the the groove 13 in the radial direction of the rod 10. The outer peripheral surface of the blade 14 can slide over the inner peripheral surface of cylinder 7, while both surfaces are kept in contact with each other.

The space between the inner peripheral surface of the cylinder 7 and the outer peripheral surface of the rod 10 is divided into a plurality of spaces by the blade 14. These divided spaces are referred to as working chambers 15.

Each of the working chambers 15 has a substantially crescent shape extending along the blade 14 from one contact portion between the rod 10 and the inner peripheral surface of the cylinder 7 to the next contact portion. The volumes of the chambers 15 decrease from the suction side to the discharge side of the cylinder 7 in accordance with the pitch of the spiral groove 13.

As is shown in FIG. 1, the first bearing 8 situated on the suction side of the cylinder 7 has a suction port 16 extending in the axial direction of the cylinder 7. One end of the suction port 16 is open to the inside of the cylinder 7, and the other end is connected to a suction tube 17 of the refrigerating cycle.

A discharge port 18 is formed in the second bearing 9 situated on the discharge side of the cylinder 7. One end of the discharge port 18 is open to the discharge-side space in the cylinder 7, and the other end thereof is open to the inside space of the sealed casing 2.

A discharge tube 19 is connected to the sealed casing 2. The discharge tube 19 is located on the discharge side of the cylinder 7 and above that end of the discharge port 18 which is open to the inside space of the sealed casing 2. The discharge tube 19 communicates with the discharge port 18 through the inside space of the sealed casing 2.

An oil reservoir 20 for receiving a lubricating oil is formed in the inner bottom part of the sealed casing 2. The lubricating oil is sucked by an oil supply mechanism 23 and supplied to the spiral groove 13, thereby applying a back pressure to the blade 14 fitted in the groove 13.

The oil supply mechanism 23 comprises an oil suck pipe 21 serving as oil guide means, oil supply path 22 and oil supply hole 22*a*.

An upper end portion of the oil suck pipe 21 is provided in the first bearing 8 and is open to the space defined by the inner peripheral surface of the bearing 8, the end face of the shaft portion 10*a* of rod 10 and the end face of the support hole 8*c*. A lower end portion of the oil suck pipe 21 is dipped in the lubricating oil in the reservoir 20.

The oil supply path 22 is a fine hole extending along the center axis A of the rod 10, from the end face of the shaft portion 10*a* of rod 10 to a certain point short of the discharge-side end of rod 10. The oil supply hole 22*a* communicates between an end portion of the oil supply path 22 and a specified area (describe later) on the bottom of the spiral groove 13.

More specifically, as is shown in FIG. 2, a groovelike gas suction port 11 extending in the axial direction of rod 10 is formed in the outer peripheral surface of the suction-side end portion of the rod 10. Part of the gas suction port 11 crosses the spiral groove 13 formed in the outer peripheral surface of rod 10.

A first working chamber 15*a*, indicated by hatched lines in FIG. 2, extends over the outer peripheral surface of rod 10 by 360° from the position of the open end of the gas suction port 11. Second and subsequent working chambers (15*b*, 15*c* . . . ) are formed following the first working chamber 15*a* by every 360°. The oil supply hole 22*a* communicates with that area of the bottom of the spiral groove 13, which corresponds to the position where the second and subsequent working chambers (15*b*, 5*c* . . . ) begin when the suction stroke of the first working chamber 15*a* ends.

More specifically, the oil supply hole 22*a* communicates with that area of the bottom of the spiral groove 13, which corresponds to the position where the boundary of the first and second working chambers 15*a* and 15*b* is situated, when the suction stroke of the first working chamber 15*a* ends.

In another mode of setting the position of the oil supply hole 22*a*, a reference position of the blade 14 is determined at the intersection of the center axis A of rod 10 and the suction-side spiral groove 13. The blade angle $\alpha$ of the reference position is 0°. The oil supply hole 22*a* is formed to communicate with that area of the bottom of the groove 13, which corresponds to the blade angle $\alpha$ of 720°, i.e. two rotations of groove 13 from the blade angle $\alpha$ of 0° towards the discharge side.

The operation of the fluid compressor having the above structure will now be described.

When electric power is supplied to the motor unit 3, the rotor 6 and the cylinder 7 formed integral with the rotor 6 are rotated.

The torque of the cylinder 7 is transmitted to the rod 10 through the torque transmission mechanism 30. The rod 10 and cylinder 7 are rotated relative to each other while part of the outer peripheral surface of the rod 10 is in contact with the inner peripheral surface of the cylinder 7. The blade 14 rotates as one body with the rod 10.

Since the blade 14 is rotated with its outer peripheral surface kept in contact with the inner peripheral surface of the cylinder 7, the blade 14 is gradually pushed in the groove 13 towards the contact area of the outer periphery of rod 10 and the inner periphery of cylinder 7, and the blade 14 is gradually projected from the groove 13 away from the contact area.

On the other hand, when the compressor unit 4 is operated, a refrigerant gas is sucked into the suction-side end of the cylinder 7 through the suction tube 17 and suction port 16, and the gas is led to the working chamber 15 through the gas suction port 11.

As is shown in FIGS. 5A to 5D, in accordance with the rotation of the rod 10 the refrigerant gas is sequentially transferred to the discharge-side working chambers 15, while it is sealed in the working chambers 15.

The volumes of the working chambers 15 are gradually decreased from the suction-side end to the discharge-side end of the cylinder 7. Thus, the refrigerant gas is gradually compressed while it is transferred to the discharge side.

The compressed refrigerant gas is discharged into the inside space of the sealed casing 2 through the discharge port 18 formed in the second bearing 9, and then the gas is returned to the refrigerating cycle through the discharge tube 19.

On the other hand, the inside of the sealed casing 2 is kept at a high pressure by virtue of the compression function, and the lubricating oil in the reservoir 20 is sucked through the oil suck pipe 21 and filled in the space 8*c* in the first bearing 8.

The lubricating oi filled in the hole 8*c* is guided through the oil supply path 22 and is led to the spiral groove 13 through the oil supply hole 22*a* formed at the end of the path 22.

The blade 14 is freely slid in and out of the groove 13. The lubricating oil is supplied to the slidably contacted parts of the blade 14 and groove 13, thus ensuring smooth movement of the blade 14. The oil is also supplied to the slidably contacted parts of the outer peripheral surface of the blade 14 and the inner peripheral surface of the cylinder 7 and to the slidably contacted parts of the first and second bearings (8, 9) and the cylinder and rod (7, 10), thus ensuring smooth movement of these.

According to the fluid compressor having the above structure, the oil supply hole 22*a* communicates with that area of the bottom of the spiral groove 13, which corresponds to the position where the second and subsequent working chambers (15*b*, 15*c* . . . ) begin when the suction stroke of the first working chamber 15*a* ends.

Alternatively, the oil supply hole 22*a* communicates with that area of the bottom of the spiral groove 13, which corresponds to the position where the boundary of the first and second working chambers 15*a* and 15*b* is situated, when the suction stroke of the first working chamber 15*a* ends. Further, alternatively, the oil supply hole 22*a* is formed to communicate with that area of the bottom of the groove 13, which corresponds to the blade angle $\alpha$ of 720°. Thus, the pressure difference between the supplied pressurized oil and the working chamber 15.

The blade 14 is always urged by the pressurized lubricating oil supplied from the bottom of the groove 13 in such a direction as to move away from the groove 13, i.e. towards the inner peripheral surface of the cylinder 7. A hydraulic pump-like function by virtue of the movement of the blade 14 in and out of the groove 13 is made smoother, and ideal oil pressure is attained.

The lubrication of the blade 14 and groove 13 is improved, and the lubricating oil can surely be supplied to other slidably contacted areas. The amount of pressurized oil leaking from the groove 13 to the working chamber 15 is decreased.

Since the blade 14 is rotated with its outer peripheral surface always contacted on the inner peripheral surface of the cylinder 7, adjacent working chambers 15 can be surely partitioned, and gas leakage between the chambers 15 can be prevented. As a result, the gas can be compressed efficiently.

In addition, the blade 14 is urged onto the inner peripheral surface of the cylinder 7; therefore, even where the manufacturing precision of parts, such as squareness of blade 14, is not so high, the blade 14 smoothly moves in the groove 13 while contacting the inner peripheral surface of the cylinder 7. Thus, the manufacture and assembly of the parts is easy.

Figure 6:
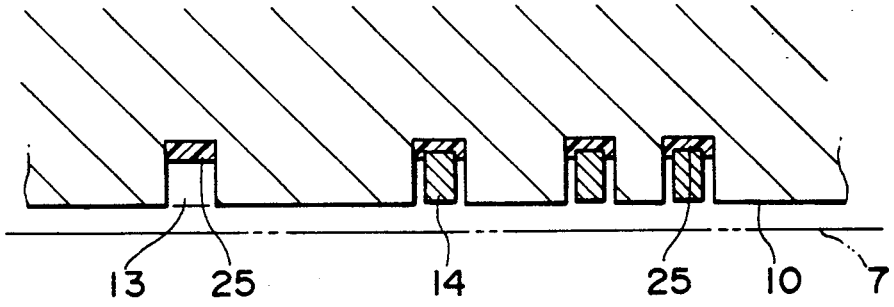
FIG. 6 is a cross-sectional view showing part of the spiral groove according to another embodiment of the invention and a blade fitted in the groove.

As is shown in FIG. 6, a sealing member 25 of an elastic material is provided along the bottom of the spiral groove 13. The sealing member 25 is put in slidable contact with the inner peripheral surface of the blade 14 which is fitted in the groove 13.

This enhances the sealing between the bottom of the groove 13 and the inner peripheral surface of the blade 14, and the pressurized lubricating oil or high-pressure gas on the discharge side is prevented from flowing back to the suction side through the groove 13.

Figure 7:
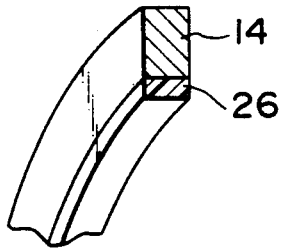
FIG. 7 is a perspective view showing part of the blade according to still another embodiment of the invention.

As is shown in FIG. 7, a sealing member 26 of an elastic material is provided along the inner peripheral surface of the blade 14, and the sealing member 26 is put in slidable contact with the bottom of the groove 13. Thus, the sealing between the bottom of the groove 13 and the inner peripheral surface of the blade 14 is enhanced, and the pressurized lubricating oil or high-pressure gas on the discharge side is prevented from flowing back to the suction side through the groove 13.

The same advantages can be obtained by providing sealing members of elastic material on both the bottom of the spiral groove 13 and the on the inner peripheral surface of the blade 14, and putting the sealing members in close contact with each other.

The present invention is not limited to the above embodiments, and various changes and modifications may be made within the scope of the subject matter of the invention. For example, the compressor of this invention is applicable not only to the refrigerating cycle but also to other types of compressors.

The compressor of this invention may be a so-called open-type compressor wherein the compressor unit and the motor unit are not housed in the sealed casing, but pipes are directly coupled to the suction port and discharge port.

In addition, the compressor of this invention may be constituted such that two spiral grooves are formed in the outer peripheral surface of the rod or rotational body, and blades are slidably fitted in the grooves.

What is claimed is:

1. An axial flow fluid compressor with an oil supply passage through a rotor, comprising:

a sealed casing having an oil receiving section for receiving a lubricating oil formed at a bottom thereof;

a cylinder housed in said sealed casing;

a cylindrical rotational body disposed within the cylinder along the axis of the cylinder and eccentrically to the axis of the cylinder, said rotational body and the cylinder being rotatable relative to each other such that part of the rotational body is put in contact with the inner peripheral surface of the cylinder, and said rotational body having at least one spiral groove formed in the outer peripheral surface of the rotational body;

a spiral blade fitted in the spiral groove so as to be freely retreated in and projected from the spiral groove in the radial direction of the rotational body, said spiral blade having an outer peripheral surface put in close contact with the inner peripheral surface of the cylinder, and said spiral blade dividing the space defined between the inner peripheral surface of the cylinder and the outer peripheral surface of the rotational body into a plurality of working chambers;

a gas suction port extending over the outer periphery of the rotational body in the axial direction of the rotational body and crossing the spiral groove, an end of the gas suction port reaching one of two working chambers located on either side of the rotational body;

a first working chamber which is one of said plurality of working chambers and is provided with the gas suction port, second and subsequent working chambers being successively formed by every 360° rotation from the first working chamber;

drive means for rotating the cylinder and the rotational body relative to each other, guiding a fluid to be compressed from the gas suction port to the first working chamber, and compressing the fluid while transferring the fluid to the second subsequent working chambers successively; and oil supply means for supplying a pressurized oil into the space between the bottom of the spiral groove and the blade, thereby urging the outer peripheral surface of the blade onto the inner peripheral surface of the cylinder, said oil supply means including an oil supply path extending along the axis of the rotational body, an oil supply hole communicating with the oil supply path and the bottom of the groove, and guide means for guiding the pressurized oil to the opening of the oil supply path formed at one end of the oil supply path, said oil supply hole communicating with an area of the bottom of the groove which corresponds positionally to the blade angle of 720 degrees being two rotations of the groove from the blade angle of 0 degrees towards the discharge side when a reference position of the blade is determined at the intersection of said gas suction port and said spiral groove an the blade angle of the reference position is 0 degrees.

2. A fluid compressor according to claim 1, further comprising:

a pair of bearings for rotatable supporting both ends of said cylinder; and a pair of shafts provided one at each of two ends of said rotational body and supported rotatable by said bearings, wherein said guide means comprises an oil suck pipe having an upper end communicating with a space defined by one of said bearings for rotatable supporting one end of the rotational body and an end face of the rotational body, and a lower end dipped in the lubricating oil in the oil reservoir, and said oil suck pipe sucks the lubricating oil and supplies the oil to the space.

3. A fluid compressor according to claim 2, wherein said one of the bearings has a suction port having one end communicating with the inside space of a suction-side end portion of the cylinder and the other end communicating with the outside of the sealed casing, and wherein the other bearing has a discharge port having one end communicating with the inside space of a discharge-side end portion of the cylinder and the other end communicating with the inside space of the sealed casing.

4. A fluid compressor according to claim 1, wherein said drive means comprises a motor unit for rotating the cylinder, and torque transmission means for transmitting a torque of the cylinder to the rotational body, thereby rotating the rotational body in synchronism with the cylinder.

5. A fluid compressor according to claim 4, wherein said motor unit comprises a rotor fixed on the outer periphery of the cylinder, and a stator situated radially outward of the rotor and fixed on the inner periphery of the sealed casing.

6. An axial flow fluid compressor with an oil supply passage through a rotor, comprising:

a sealed casing having an oil receiving section for receiving a lubricating oil formed at a bottom thereof;

a cylinder housed in said sealed casing;

a cylindrical rotational body disposed within the cylinder along the axis of the cylinder and eccentrically to the axis of the cylinder, said rotational body and the cylinder being rotatable relative to each other such that part of the rotational body is put in contact with the inner peripheral surface of the cylinder, and said rotational body having at least one spiral groove formed in the outer peripheral surface of the rotational body;

a spiral blade fitted in the spiral groove so as to be freely retreated in and projected from the spiral groove in the radial direction of the rotational body, said spiral blade having an outer peripheral surface put in close contact with the inner peripheral surface of the cylinder, and said spiral blade dividing the space defined between the inner peripheral surface of the cylinder and the outer peripheral surface of the rotational body into a plurality of working chambers;

a first working chamber which is one of said plurality of working chambers and is provided with a gas suction port, second and subsequent working chambers being successively formed by every 360° rotation from the first working chamber;

drive means for rotating the cylinder and the rotational body relative to each other, guiding a fluid to be compressed from the gas suction port to the first working chamber, and compressing the fluid while transferring the fluid to the second and subsequent working chambers successively; and oil supply means for supplying a pressurized oil into the space between the bottom of the spiral groove and the blade, thereby urging the outer peripheral surface of the blade onto the inner peripheral surface of the cylinder, said oil supply means including an oil supply path extending along the axis of the rotational body, an oil supply hole communicating with the oil supply path and an area of the bottom of the spiral groove which corresponds to the position where one of the second and subsequent working chambers begins when the suction stroke of the first working chamber ends, and guide means for guiding the pressurized oil to the opening of the oil supply path formed at one end of the oil supply path, and a sealing member formed of elastic material and provided on at least one of the bottom of the spiral groove and the inner peripheral surface of the blade.

7. A fluid compressor according to claim 6, wherein sealing members of an elastic material are provided on both the bottom of the spiral groove and on the inner peripheral surface of the blade.

* * * * *